US006220356B1

(12) United States Patent
Spikes

(10) Patent No.: US 6,220,356 B1
(45) Date of Patent: Apr. 24, 2001

(54) METHOD AND APPARATUS FOR WELL TREATING

(76) Inventor: Larry Spikes, Rte. 3, Box 230, Jefferson, TX (US) 75657

( * ) Notice: Subject to any disclaimer, the term of this patent is extended or adjusted under 35 U.S.C. 154(b) by 0 days.

(21) Appl. No.: 09/273,516

(22) Filed: Mar. 22, 1999

(51) Int. Cl.[7] ..... E21B 21/14; E21B 37/00

(52) U.S. Cl. ..... 166/309; 166/177.3; 166/311; 166/63; 166/162

(58) Field of Search ..... 166/107, 177.3, 166/309, 311, 63, 117, 162

(56) References Cited

U.S. PATENT DOCUMENTS 3,199,596 * 8/1965 Wood ..... 166/115
3,219,115 * 11/1965 Hower et al. ..... 175/69
3,265,133 * 8/1966 Burch ..... 166/177.3
4,237,977 * 12/1980 Lutener ..... 166/309
4,611,664 * 9/1986 Osterhoudt, III et al. ..... 166/305.1
4,721,159 * 1/1988 Ohkochi et al. ..... 166/286
4,790,386 * 12/1988 Johnson et al. ..... 166/310
5,515,924 * 5/1996 Osterhoudt, III ..... 166/309
5,758,725 * 6/1998 Streetman ..... 166/304

* cited by examiner

*Primary Examiner*—David Bagnell
*Assistant Examiner*—Jennifer R Dougherty
(74) *Attorney, Agent, or Firm*—Vinson & Elkins, L.L.P.

(57) ABSTRACT

A well, such as a natural gas well, may be treated to increase production of gas by inserting into the tubing string a water soluble carrier containing a well treating chemical adapted to aerate fluids standing in the tubing string. The dissolvable carrier contains a compressed swab adapted, upon dissolution of the carrier, to expand to fill the diameter of the tubing string, and well treating chemicals adapted to aerate the standing fluid in the well above and below the swab. The presence of the aerating fluids in the well lighten the hydrostatic head, permitting a plug of fluid above the swab to be displaced from the well as the swab is urged upward due to pressure exerted on the swab by the formation and by the aerating effect of well treating chemicals released below the swab. The dissolvable materials for the carrier preferably are selected so that the carrier will not dissolve until it has reached a seating nipple near the lower end of the tubing string, thus assuring that the maximum slug of fluid is displaced from the well bore above the swab.

17 Claims, 3 Drawing Sheets

FIG. 1E
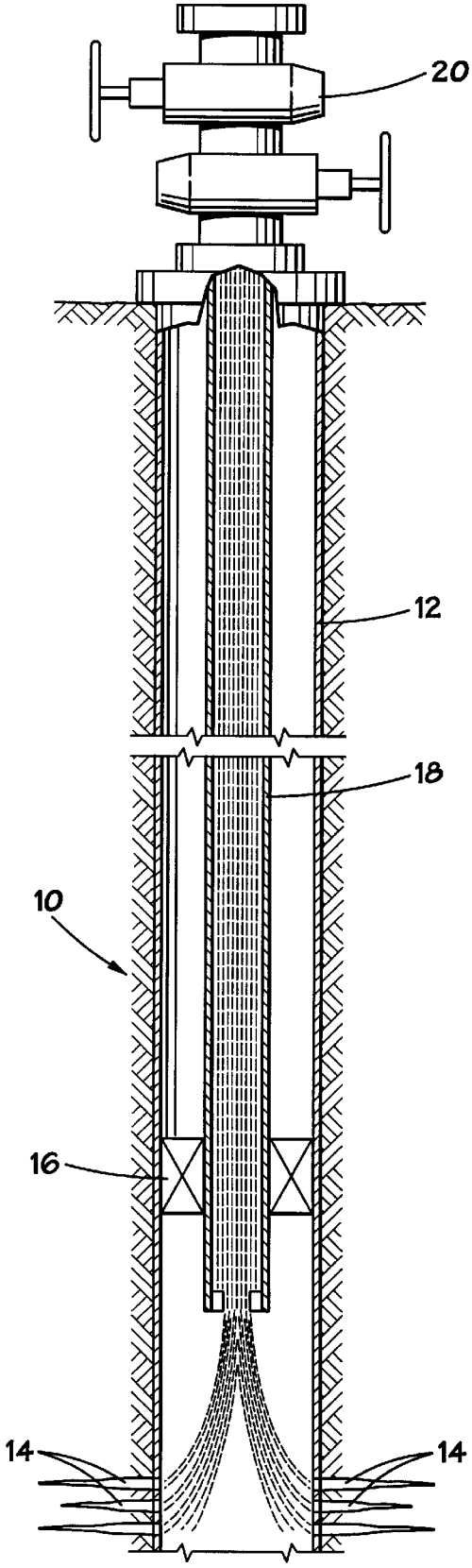
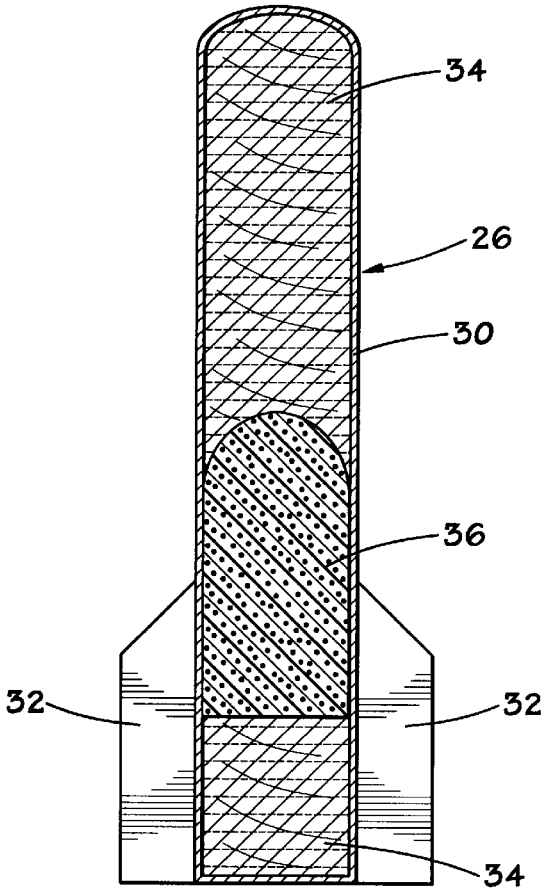
FIG. 2

METHOD AND APPARATUS FOR WELL TREATING

FIELD OF THE INVENTION

This invention relates to the field of well treating methods designed to reinitiate flow and commercial production in oil and gas wells which have reduced ability to produce hydrocarbons due to a standing column of fluid in the production tubing exerting excessive hydrostatic pressure on the production formation.

BACKGROUND OF THE INVENTION

In the normal life of a commercially viable oil or gas well it is common for the well to produce water in conjunction with the desired hydrocarbons. In the early stages of production, the flowing pressures are sufficient to carry the undesired water up through the tubing and out of the well to be separated from the hydrocarbons at the surface. After a period of time, as the subterranean reservoir being produced begins to be depleted, the pressures of the reservoir decrease and the rate of the hydrocarbons flow in turn decreases. When this occurs, the flow and pressure decreases have an adverse affect on the capacity of the well to carry and remove the undesired water being produced by the well. This is especially true in natural gas wells. When the well cannot carry co-produced water out of the well bore, it builds up in the production tubing until it literally shuts off flow to the surface. This is commonly known as a dead or drowned well.

In the past, in wells which there has been some production of gas still continuing despite accumulated water, a foaming agent, such as soap or another water-soluble surfactant, has been added to the well, either in liquid or stick form. At present, soap sticks are available in two general types. In the first type, the soap material is a solid and is molded to comprise an elongated rod shaped member which are dropped into the well. The other technique incorporates the use of a water soluble carrier into which the liquid soap material is placed. These soap sticks are bought by the well operator and the gauger drops the sticks into the well. The water in the well dissolves the stick, thereby releasing the soap to create foam.

Such products have been found very efficient in lowering the surface tension of the water and are capable of producing large volumes of foam where the well is producing some gas. The gas entering the well will provide the necessary agitation and gas to transform the now soapy column of fluid into foam, thus lightening the standing column weight and making it easier for the bottom hole pressure to push this now column of foam upward in the well bore and carry the water contained therein to the surface for disposal by conventional methods. This method has been found very effective in removing water from a well while there is still sufficient gas production (i.e., agitation) to effect such foaming. The method just described will not readily produce flow in a well which has been drowned to such a degree that it is not producing a substantial quantity of gas. Although it may eventually produce enough foam to start the liquid flowing from most such wells, the time element involved is in many instances so great as to make it impractical.

Previously, when a well had reached the point where the agitation provided by the well was insufficient to utilize the soap stick process, the operator dealt with the problem mechanically. These methods include a process known as swabbing, which entails literally bailing the undesired water column from the well bore. A plunger is run down the well on a wire line and the water is physically removed. Other alternatives consist of expensive pumping equipment permanently installed in the well. All of such mechanical water removal methods require expensive equipment and considerable time and labor.

U.S. Pat. No. 5,515,924 discloses a technique for reviving water drowned oil and/or gas wells by using a uniformly commingled blend of virtually water free surfactants, foamers and gas generating chemicals manufactured in a solid, cylindrical shape to be dropped down the production tubing. The cylinder of chemicals, upon contact with down hole water, transforms the water into foam, thus lightening the hydrostatic pressure in the well to allow the bottom hole pressure in the well to flow the foam out of the well bore and return the well to commercial production.

U.S. Pat. No. 4,611,664 discloses a technique for delivering liquid chemicals, such as corrosion inhibitors, to the producing zone of the well bore by pouring the chemical into an elongated carrier which is dropped into the well bore. The carrier material is selected so that the liquid chemical contained inside the carrier will dissolve the carrier in the well bore, thereby releasing the chemical into the well formation.

U.S. Pat. No. 5,758,725 discloses a method and apparatus for improving well flow in which a stick of well treating chemical is attached to a plunger for insertion into the well bore. The stick may be either a solid stick of dissolvable well treating chemical, or a dissolvable tube or cylinder containing well treating chemical which will be digested by the chemical after it is inserted into the well bore. Among the chemicals suggested for use with this method are foaming agents for lightening the density of well fluids.

Summary of the Invention The present invention comprises the technique for reviving water drowned or poorly flowing oil and/or gas wells by using a water-soluble carrier to hold liquid soap or other desired foaming agent, or well treating chemicals capable of generating gases upon exposure to water. The water soluble carrier will dissolve in the water standing in the well, releasing the treating chemical. Inside the carrier, there is placed a compressed plug of fabric, plastic or cellular foam. When the tube dissolves, the plug material expands to act as a swab. The soap, foaming agent or other well treating chemical is released above and below the swab, creating bubbles which lighten the standing liquid in the well bore. Formation gas pressure from below the swab will assist in pushing the swab up through the tubing string. The presence of the full bore swab tends to be more effective in displacing a large plug of fluid to the surface than are the prior art methods. The swab is displaced from the tubing string along with the water plug, after which the well will continue to produce until the fluid level again builds up sufficient pressure to block or reduce gas flow, after which the process can be repeated.

The objects and advantages of the invention will be more fully apparent from the following detailed description of a preferred embodiment of the invention and from the accompanying drawings and appended claims.

BRIEF DESCRIPTION OF DRAWINGS

In the accompanying drawings, in which like numerals indicate like parts:

FIG. 1E illustrates the well bore after the plug of fluid and swab have been displaced and normal well flow restored; and FIG. 2 is an enlarged view of the carrier of FIG. 1.

DETAILED DESCRIPTION

Figure 1A:
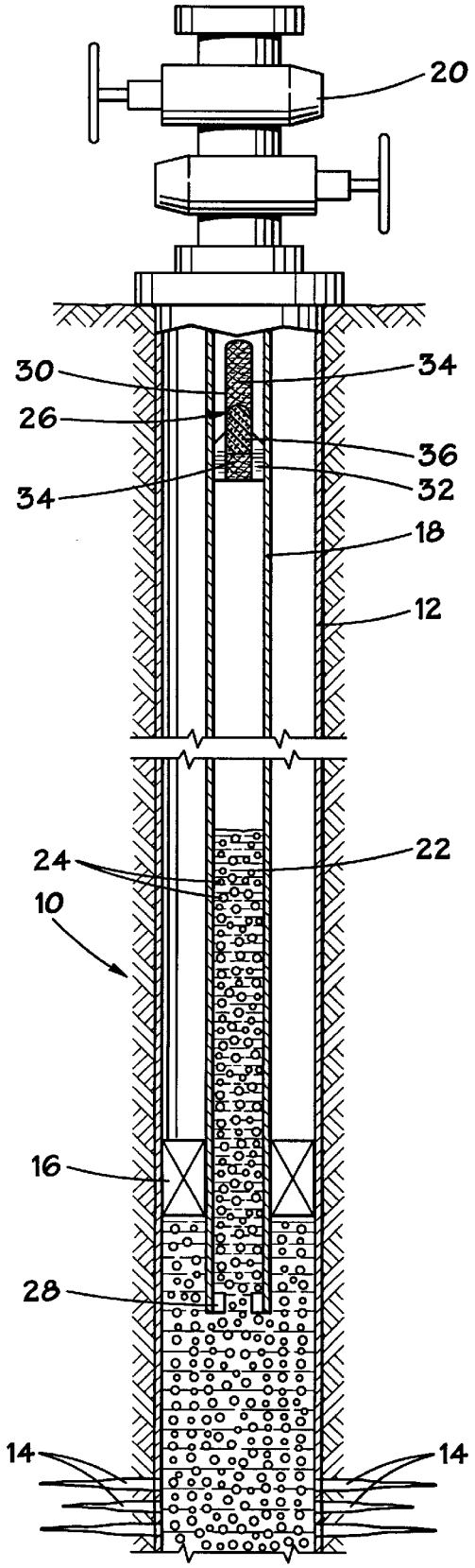
FIG. 1A is schematic illustration (not to scale) of a well bore in which the flow of formation fluids through the tubing string is being obstructed by the hydrostatic pressure of standing water in the tubing string.
Figure 1B:
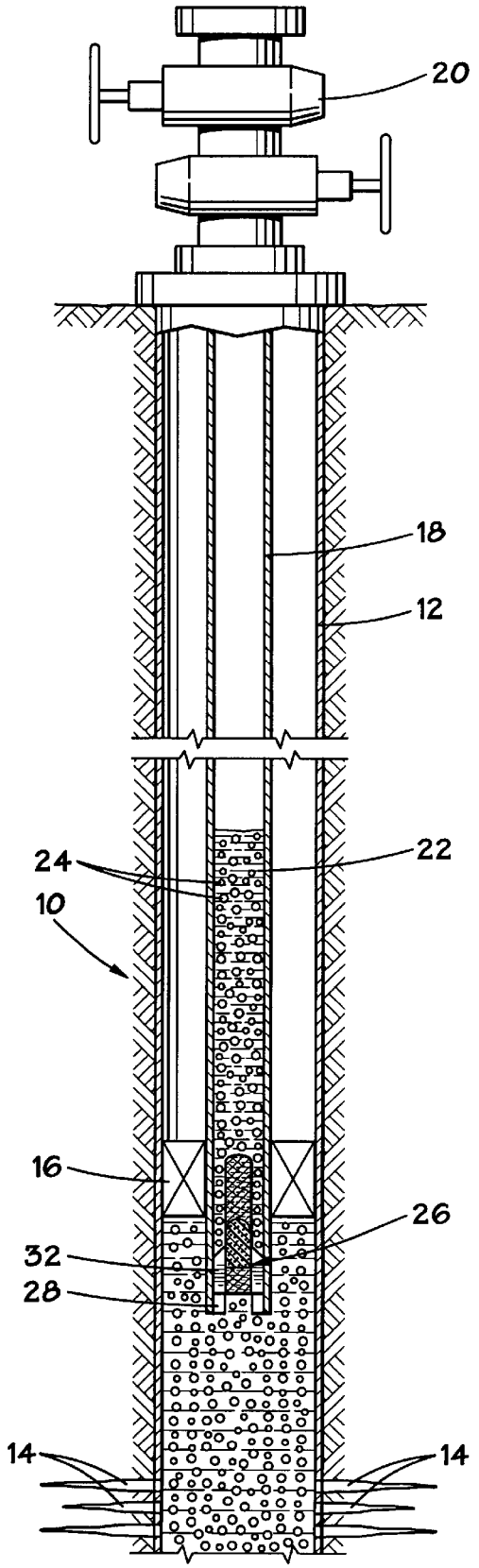
FIG. 1B illustrates the same well bore with the dissolvable carrier containing the well treating chemical and swab seated at the lower end of the tubing string.

Referring to FIG. 1A, there is shown a typical producing well 10 located at a well site. The well includes a bore hole drilled into the earth and lined with casing 12. Perforations 14 have been provided in the wall of the casing by a perforating gun (not shown) in order to provide communication with a subterranean zone or formation which is producing petroleum, such as natural gas, alone or commingled with oil. A packer 16 and tubing string 18 have been lowered into the well and manipulated to set the packer 16 to provide a seal between the tubing string 18 and the inside wall of casing 12. The tubing string has been swabbed to bring the well in and allow the hydrocarbon fluids in the formation to flow into the bottom of the well 10, up the tubing string and out through the Christmas tree, indicated schematically at 20. The Christmas tree contains valving and conduit means, not shown, for permitting access to the inside of the tubing string, as well as for connecting the tubing string to separation tanks, pipe lines or other apparatus for receiving or treating the products produced from the well.

Formation zones producing natural gas also frequently produce quantities of water, or sometimes water mixed with oil, which are carried to the surface with the gas rising through the tubing string 18, where they subsequently are separated from the gas. However, as the pressure of the gas being produced through the well declines over time, the rate of gas flow may lose its ability to displace all co-produced fluids to the surface. When this happens, fluid levels eventually build up inside the tubing string as indicated by standing fluid 22. It will be appreciated that as the height of the standing column of fluid increases, it exerts an increasing hydrostatic pressure on the formation, thus reducing the rate of gas production. Gas will continue to be produced from the formation for a period of time, rising through the standing column as gas bubbles, represented by bubbles 24 in FIG. 1A. If the condition continues untreated, the hydrostatic pressure eventually will equal the formation pressure, completely cuffing off production of gas from the well. It is, of course, desirable to treat the condition before the well is completely killed.

For the purpose of treating the well there is provided in accordance with the present invention a carrier 26 adapted to carry the desired well treating chemicals down through the tubing string, the column of fluid standing in the fluid string and onto a seat 28 disposed near the lower end of the tubing string. The carrier includes an elongated hollow cylindrical body 30, preferably closed at each end and preferably having an outside diameter substantially less than the inside diameter of the tubing string 18. Fins or extensions 32 are provided on the carrier body for seating the carrier on the seating surface 28.

Inside the carrier body there are provided suitable well treating chemicals 34 adapted to create the necessary foam or bubbles for lightening the hydrostatic pressure of the standing column of fluid in the tubing string, so that it can be displaced from the well bore by the natural pressure of the formation. If the well is continuing to produce some gas, as illustrated in FIG. 1A, then the treating chemicals may be liquid soap, solid soap or other desired detergents, surfactants or foaming agents adapted, when exposed to the turbulence of the bubbles rising through the standing column of fluid, to turn the liquid column to foam, to thereby reduce the hydrostatic pressure exerted by the fluid on the formation. If the well already has been "killed" by the hydrostatic pressure of the fluid, so that no bubbles are rising through the standing column of fluid, then the well treating chemicals may also include suitable chemicals adapted, upon exposure to water, to automatically generate gas to provide the necessary foam for reducing fluid column pressure.

In accordance with the present invention, the carrier 30, or a desired portion thereof such as the cylindrical body, is formed of a water-soluble material such as a water-soluble polymer or resin adapted to dissolve upon exposure to water or a material, such as paper or cardboard, adapted to substantially weaken or disintegrate upon exposure to water. Thus, the body, or the water-soluble portions thereof, will begin to dissolve or disintegrate once they encounter the water standing in the tubing string.

Also disposed within the body of carrier 26 there is provided a compressed swab 36 adapted, upon expansion, to substantially fill the inside diameter of the tubing string 18. The swab may be formed of any suitable compressive and preferably water insoluble material such as closed or open cell polymer foam, cellulose, or the like. Alternatively, the swab may be formed of a material such as desiccated sponge, which upon exposure to water will swell to fill the tubing bore. If desired, the swab also could be made of paper, water-soluble polymer, or other material adapted to dissolve or disintegrate upon prolonged exposure to water. However, the swab should remain intact for long enough to perform its function of displacing a slug of liquid to the surface.

Figure 1C:
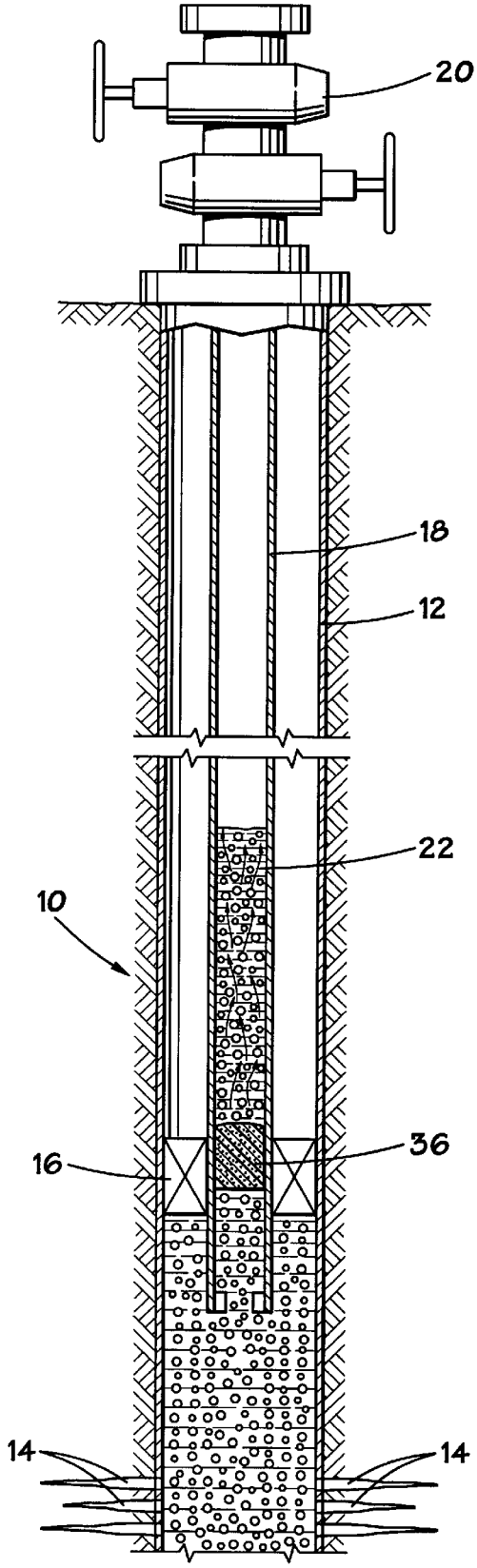
FIG. 1C illustrates the same well bore after the cylinder of well treating chemical has dissolved and the swab material contained in the cylinder has expanded to fill the bore of the tubing string.
Figure 1D:
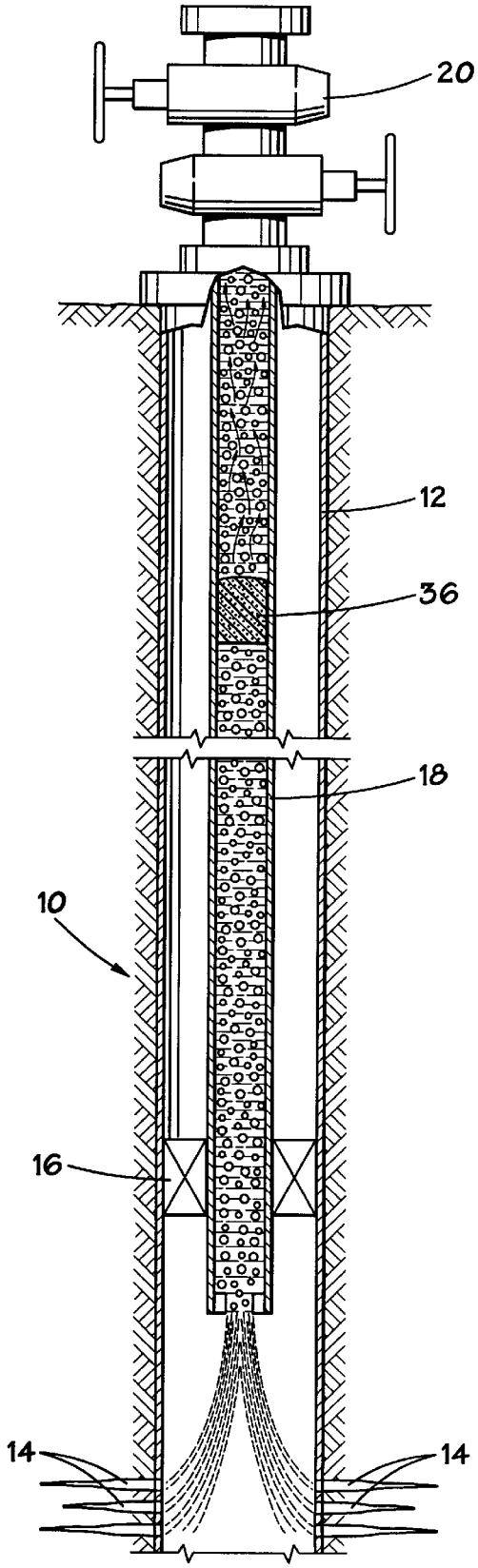
FIG. 1D illustrates the same well bore with the plug of fluid above the expanded swab being displaced up the tubing string.

Once the dissolvable portion of carrier 26 has dissolved in the well fluid, the compressed swab will be released and will expand to fit tightly against the tubing walls as indicated in FIG. 1C. The well treating chemicals are released as the carrier body dissolves and admix with the well fluid to generate or increase the bubbles in the fluid to lighten the hydrostatic head. Treating chemicals preferably are released above and below the swab so as to aerate the fluid standing in the tubing string above the swab and in the vicinity of the well formation below the swab.

The carrier will begin to dissolve as soon as it contacts the standing fluid in the tubing. However, it is desirable that the swab be placed near the bottom of the tubing string before it expands, so as to displace the largest possible slug of standing fluid from the tubing. Accordingly, it is preferable that the material for the dissolvable carrier, and its thickness, be selected so that the carrier will pass through the column of standing fluid and be seated on the seat 28 near the bottom of the tubing string before the carrier dissolves, releasing the treating chemicals and the swab.

The expanded swab provides a substantial barrier against fluid leaking around it and back down into the well bore. This provides a significant improvement over prior art processes, in that it assures that a larger and continuous plug of fluid is displaced up the tubing string.

Once the treating chemicals and swab are released, the chemicals above the swab will serve to increase the aeration of the fluid in the tubing string above the swab while those below the swab will aerate the fluid in the vicinity of the well formation and provide aeration to assist in displacing the swab up the tubing string. As the swab is produced to the surface through the tubing string (FIG. 1D), it will displace the aerated plug of fluid above it from the tubing string while the fluid below the swab is aerated both by treating chemicals from the carrier and by additional gas flowing from the formation into the well bore. Once the swab and the slug of fluid above the swab have been displaced from the well bore, gas flow from the well should resume at its normal flow rate due to the decreased of hydrostatic pressure on the well (FIG. 1 E). This condition will continue until the build-up of fluid again becomes a problem, after which the process can be repeated. Where the well being treated is still producing sufficient gas, the carrier and swab also could be used to displace a plug of fluid to the surface merely by using the dissolvable carrier to place the expandable swab on the seat 28. When so used, the carrier could be merely a cylinder for compressing the swab, but open at the top and bottom. Alternatively, it could be closed at the top and bottom and contain water or other inert chemicals merely for adding weight. In either event, it is apparent that the swab and cylinder should have sufficient weight to pass down through the column of fluids standing in the well. Once seated on the seat 28, the carrier will dissolve and the swab will expand to fill the tubing bore. Continued production of gas from the formation eventually will create sufficient pressure to displace the expanded swab, and the column of fluid above it, to the surface, thus relieving hydrostatic pressure on the well and increasing the rate of gas production. Where used without well treating chemicals, it is also apparent that the compressed swab could be held in its compressed state merely by bands or filaments of a dissolvable material, such as a polymer and suitably weighted, to pass through the standing column of fluid to reach the seat 28. Once the confining bands or filaments dissolve, the swab would expand and function as described above.

The foregoing disclosure and description of the invention are illustrative only, and various changes may be made in the size, shape and materials of construction, without departing from the spirit of the invention, which is measured by the appended claims.

What is claimed is:

1. A device for increasing hydrocarbon recovery from a well by enhancing the flow of hydrocarbon from a formation into said well, said device comprising a carrier comprising a body formed, at least in part, from a water soluble material, said body having an outside diameter and configuration adapting it to be received within a production tubing string in said well, passed through a column of water standing in said tubing string and seated on a seat in said tubing string, said body of said carrier defining a closed central cavity from which said water standing in said tubing string is excluded as said carrier moves through said column of water, said water soluble material used in said carrier body being so selected and dimensioned so that said carrier body will be seated on said seat prior to the dissolution of said water soluble material:

a well treating chemical contained in said central cavity and adapted, upon exposure to water, to assist in the aeration of fluid contained in said tubing string; and a compressed swab in said central cavity adapted, upon dissolution of said water soluble portion of said body, to expand to substantially uniformly fill the inside diameter of said tubing string and to engage the inside walls of said tubing string;

whereby, said device may be introduced into said tubing string of said well and seated on said seat and, upon dissolution of said water soluble portion of said body, will release said well treating chemical and said swab into the fluid contained in said tubing string.

2. The apparatus according to claim 1 wherein said well treating chemical comprises a surfactant.

3. The apparatus according to claim 1 wherein said well treating chemical comprises a chemical compound adapted to generate gas upon exposure to water.

4. The apparatus according to claim 1 wherein said swab is formed of a compressed, substantially water insoluble, material.

5. The apparatus according to claim 1 wherein said swab is formed of a water-soluble material.

6. The apparatus according to claim 1 wherein said swab is formed of a dry material adapted to expand upon dissolution of said carrier.

7. A method for increasing production of natural gas from a well having a natural gas producing zone, a production tubing extending from substantially the depth of said natural gas producing zone to the surface of said well, said production tubing string including a seat in said tubing string in the vicinity of said gas producing zone and said well having a column of fluid standing in said well in the vicinity of said gas producing zone and extending up into the bore of said tubing string above the location of said seat, said method comprising the steps of (a) providing a carrier having a body formed at least in part of a material soluble in said well fluid, said carrier defining a closed central cavity containing a quantity of well treating chemical adapted, upon exposure to said well fluid, to aerate said well fluid so as to reduce the hydrostatic pressure acting on said natural gas producing zone and also containing a compressed swab adapted to expand to substantially uniformly fill the inside diameter of said tubing string and to engage the inside walls of said tubing string;

(b) inserting said carrier into the bore of said tubing string at the surface of said well;

(c) seating said carrier on said seat;

(d) dissolving said portion of said carrier soluble in said well fluid so as to release said well treating chemical and said swab;

(e) expanding said swab to substantially uniformly fill the internal diameter of the bore of said production tubing;

(f) aerating said well fluid above and below said swab as a result of contact of said well fluid with said well treating chemical released from said carrier; and (g) producing said swab and a slug of well fluid above said swab to the surface.

8. The method according to claim 7 wherein said well treating chemical comprises a surfactant.

9. The method according to claim 7 wherein said well treating chemical comprises a chemical compound adapted to generate gas bubbles upon exposure to said well fluid.

10. The method according to claim 7 wherein said swab is formed of a compressed, substantially water insoluble, material.

11. The method according to claim 7 wherein said swab is formed of a compressed water-soluble material.

12. The method according to claim 7 wherein said swab is formed of a dry material adapted to swell upon exposure to water.

13. A device for increasing hydrocarbon recovery from a well by enhancing the flow of hydrocarbon from a formation into said well, said device comprising:

(a) a swab adapted to the received within the bore of a production tubing string in said well said swab being formed of a dry material adapted to swell upon exposure to water;

(b) water-soluble means for temporarily protecting said swab from exposure to water and adapted, upon exposure to water, to dissolve and expose said swab to water;

(c) whereby said device may be introduced into said tubing string of said well and, upon dissolution of said water-soluble means said swab will be exposed to water and will expand to engage the inside walls of said tubing string.

14. The apparatus according to claim 13 wherein said water-soluble means for retaining said swab comprise a carrier having a body formed of water-soluble material.

15. The apparatus according to claim 13 wherein said swab is formed of a substantially water-insoluble material.

16. The apparatus according to claim 13 wherein said swab is formed of a water-soluble material.

17. A method for increasing production of natural gas from a well having a natural gas producing zone, a production tubing extending from substantially the depth of said natural gas producing zone to the surface of said well and said well having a column of fluid standing in said well in the vicinity of said gas producing zone and extending up into the bore of said tubing string, said method comprising the steps of (a) providing a compressed swab formed of water soluble material and adapted, in its compressed state, to be received within the bore of said tubing string, said swab being retained in its compressed state by water-soluble retaining means adapted dissolve upon exposure to said fluid in said tubing string;

(b) inserting said swab into the bore of said tubing string at the surface of said well;

(c) dissolving said retaining means in said well fluid so as to release said swab;

(d) expanding said swab to fill the interior diameter of the bore of said tubing string; and (e) producing said swab and a slug of fluid above said swab to the surface by means of gas pressure from said gas producing zone, (f) said water soluble material forming said swab being adapted not to dissolve until said swab has been produced to the surface.

* * * * *